US007786039B2

(12) United States Patent
Koide et al.

(10) Patent No.: US 7,786,039 B2
(45) Date of Patent: Aug. 31, 2010

(54) HEAT-SENSITIVE TRANSFER IMAGE-RECEIVING SHEET AND METHOD OF PRODUCING THE SAME

(75) Inventors: Tomoyuki Koide, Minami-ashigara (JP); Kiyoshi Irita, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 851 days.

(21) Appl. No.: 11/641,055

(22) Filed: Dec. 19, 2006

(65) Prior Publication Data

US 2007/0148378 A1 Jun. 28, 2007

(30) Foreign Application Priority Data

Dec. 21, 2005 (JP) ..... 2005-368350

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS

| | | | | |
|---|---|---|---|---|
| 5,418,207 | A | 5/1995 | Asajima et al. | |
| 5,902,770 | A | 5/1999 | Narita et al. | |
| 2006/0046931 | A1 * | 3/2006 | Nakane et al. ..... | 503/201 |

FOREIGN PATENT DOCUMENTS

| | | |
|---|---|---|
| JP | 5-147364 | 6/1993 |
| JP | 8-25813 | 1/1996 |
| JP | 11-321128 | 11/1999 |

* cited by examiner

*Primary Examiner*—Bruce H Hess
(74) *Attorney, Agent, or Firm*—Sughrue Mion, PLLC

(57) ABSTRACT

A heat-sensitive transfer image-receiving sheet having, on a support, at least one receptor layer containing a latex polymer and at least one heat insulation layer containing a hollow polymer, and further having, between the support and the heat insulation layer, at least one intermediate layer which contains one or both of 1) a latex polymer having a lower glass transition point than the latex polymer in the receptor layer and 2) a water-soluble polymer.

19 Claims, No Drawings

HEAT-SENSITIVE TRANSFER IMAGE-RECEIVING SHEET AND METHOD OF PRODUCING THE SAME

FIELD OF THE INVENTION

The present invention relates to a heat-sensitive transfer image-receiving sheet and a method of producing the same. In particular, the present invention relates to a heat-sensitive transfer image-receiving sheet that ensures prevention of image defects and a method of producing the same.

BACKGROUND OF THE INVENTION

Various heat transfer recording methods have been known so far. Among these methods, dye diffusion transfer recording systems attract attention as a process that can produce a color hard copy having image qualities closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

General paper may be used as a support of an image-receiving sheet in this dye diffusion transfer recording system, and it enables the image-receiving sheet to be produced at low costs. In an image-receiving sheet using such paper as the support, a layer having high cushion properties, for example, a foam layer made of a resin and a foaming agent, is positioned between the support and a receptor layer, to provide cushion properties in order to supplement cushion properties of the support, thereby improving the adhesion between an image-receiving sheet and an ink sheet. Also, an intermediate layer is further laid between this foam layer and the receptor layer, to prevent the foam layer from being broken (flatten) by heating during printing. However, there are caused certain problems in current image-receiving sheets because of the fact that this intermediate layer is being formed by using an organic-solvent-type resin coating solution. The problems are that this coating solution breaks down air cells and voids in the foam layer, and thus, desired cushion properties are not attained, resulting in voids and density unevenness in the formation of an image, and further reduction in the heat insulation property of the foam layer is caused, resulting in diffusion of the calories required to transfer dyes, in the direction of the backside of the image-receiving sheet, bringing about reduction in sensitivity that is required for printing.

For example, JP-A-8-25813 ("JP-A" means unexamined published Japanese patent application) discloses use of an aqueous-type coating solution to form an intermediate layer between a foam layer and a receptor layer, to utilize subtle unevenness of the foam layer as it is, as the surface form of the receptor layer. However, in this method, the receptor layer is applied after application of the foam layer on a support and drying of the foam layer under heating, and therefore, there is the problem that not only do many image defects arise due to the delicate unevenness formed on the receptor-layer surface, but also the receptor layer has insufficient sensitivity and is expensive. Also, JP-A-11-321128 discloses that an intermediate layer containing, as its major components, hollow particles and a polymer resistant to an organic solvent, is formed between a support and a receptor layer; and also, JP-A-5-147364 discloses that a resin layer including a dye receptor layer is made to contain a hollow capsule. In these methods, however, the receptor layer is likewise applied after the intermediate layer and the resin layer are applied and dried under heating, and therefore, there is the problem that not only do many image defects arise due to the unevenness formed on the receptor-layer surface, but also the receptor layer has insufficient sensitivity and is expensive.

SUMMARY OF THE INVENTION

A heat-sensitive transfer image-receiving sheet having, on a support, at least one receptor layer containing a latex polymer and at least one heat insulation layer containing a hollow polymer, and further .having, between the support and the heat insulation layer, at least one intermediate layer which contains one or both of 1) a latex polymer having a lower glass transition point than the latex polymer in the receptor layer and 2) a water-soluble polymer.

A method of producing a heat-sensitive transfer image-receiving sheet, comprising the step of simultaneously coating, on a support, at least one receptor layer, at least one intermediate layer, and at least one heat insulation layer in a multilayered state.

Other and further features and advantages of the invention will appear more fully from the following description.

DETAILED DESCRIPTION OF THE INVENTION

As a result of our intensive studies, it has been found that a heat-sensitive transfer image-receiving sheet having, on a support, at least one receptor layer containing a latex polymer and at least one heat insulation layer containing a hollow polymer can be made without forming asperities (unevenness) on the receptor layer surface, when at least one intermediate layer contains one or both of 1) a latex polymer having a lower glass transition point than the latex polymer in the receptor layer and 2) a water-soluble polymer, is provided between the support and the heat insulation layer, and thereby an image-receiving sheet high in sensitivity and free of image defects can be formed at low cost. The present invention was made based on these findings.

The present invention provides the following means:

(1) A heat-sensitive transfer image-receiving sheet having, on a support, at least one receptor layer containing a latex polymer and at least one heat insulation layer containing a hollow polymer, and further having, between the support and the heat insulation layer, at least one intermediate layer which contains one or both of 1) a latex polymer having a lower glass transition point than that of the latex polymer in the receptor layer and 2) a water-soluble polymer.

(2) The heat-sensitive transfer image-receiving sheet as described in (1), wherein the intermediate layer contains the latex polymer having a lower glass transition point than that of the latex polymer in the receptor layer.

(3) The heat-sensitive transfer image-receiving sheet as described in (1), wherein the intermediate layer contains the water-soluble polymer.

(4) The heat-sensitive transfer image-receiving sheet as described in (1) or (2), wherein a glass transition point of the latex polymer contained in the receptor layer is −30° C. to 100° C.

(5) The heat-sensitive transfer image-receiving sheet as described in any of (1), (2), and (4), wherein the glass transition point of the latex polymer contained in the intermediate layer is lower than that of the latex polymer contained in the receptor layer by 10° C. to 150° C.

(6) The heat-sensitive transfer image-receiving sheet as described in any one of (1), (2), (4), and (5), wherein the glass transition point of the latex polymer contained in the intermediate layer is 60 ° C. or less.

(7) The heat-sensitive transfer image-receiving sheet as described in any one of (1) to (6), wherein the glass transition point of the hollow polymer is 70° C. or more.

(8) The heat-sensitive transfer image-receiving sheet as described in any one of (1) to (7), wherein the heat insulation layer contains a hollow polymer having a glass transition point of 70° C. or more in a content of at least 50 parts by mass on a solids basis when a content of binder resin forming the heat insulation layer is taken as 100 parts by mass on a solids basis.

(9) The heat-sensitive transfer image-receiving sheet as described in any one of (1) to (8), wherein a total coating amount of the intermediate layer in a dried state is at least 120% of a total coating amount of the heat insulation layer in a dried state.

(10) The heat-sensitive transfer image-receiving sheet as described in (1) or (2), wherein the heat insulation layer contains a hollow polymer having a glass transition point of 70° C. or higher in a content of at least 50 parts by mass on a solids basis when a content of binder resin forming the heat insulation layer is taken as 100 parts by mass on a solids basis, wherein the intermediate layer contains a latex polymer having a glass transition point of 60° C. or lower, and wherein a coating amount of the intermediate layer in a dried state or a sum of coating amounts of the intermediate layer and the receptor layer in a dried state, is at least 120% of a total coating amount of the heat insulation layer in a dried state.

(11) The heat-sensitive transfer image-receiving sheet as described in (10), wherein the coating amount of the intermediate layer in a dried state or the sum of the coating amounts of the intermediate layer and the receptor layer in a dried state is at least 150% of a total coating amount of the heat insulation layer in a dried state.

(12) The heat-sensitive transfer image-receiving sheet as described in (10), wherein the coating amount of the intermediate layer in a dried state or the sum of the coating amounts of the intermediate layer and the receptor layer in a dried state is at least 170% of a total coating amount of the heat insulation layer in a dried state.

(13) The heat-sensitive transfer image-receiving sheet as described in any one of (1) to (12), which has, between the receptor layer and the heat insulation layer, an intermediate layer which is selected from an intermediate layer containing a latex polymer having a lower glass transition point than that of the latex polymer in the receptor layer and an intermediate layer containing a water-soluble polymer.

(14) The heat-sensitive transfer image-receiving sheet as described in any one of (1) to (13), wherein the support is a paper support both sides of which are laminated by a thermoplastic resin.

(15) The heat-sensitive transfer image-receiving sheet as described in any one of (1) to (13), wherein the support is a paper support both sides of which are laminated by a thermoplastic resin, which is a polyethylene.

(16) The heat-sensitive transfer image-receiving sheet as described in any one of (14) or (15), wherein the heat insulation layer contains a hollow polymer having a glass transition point of 70° C. or higher in a proportion of 50 mass % or above, and wherein a coating amount of the thermoplastic resin laminating the support on the side to which images are to be transferred is at least 120% of a coating amount of the heat insulation layer in a dried state.

(17) The heat-sensitive transfer image-receiving sheet as described in any one of (14) to (16), wherein the heat insulation layer contains a hollow polymer having a glass transition point of 70° C. or higher in a proportion of 50 mass % or above, and wherein the sum of a coating amount of the receptor layer in a dried state, a coating amount of the intermediate layer in a dried state, and a coating amount of the thermoplastic resin laminating the support on the side to which images are to be transferred is at least 150% of a coating amount of the heat insulation layer in a dried state.

(18) A method of producing a heat-sensitive transfer image-receiving sheet, comprising the step of coating, on a support, at least one receptor layer, at least one intermediate layer, and at least one heat insulation layer by a simultaneous multilayer coating.

The heat-sensitive transfer image-receiving sheet of the present invention has high sensitivity, is free from image defects, and can be produced at low costs.

The present invention will be explained in detail below.

The heat-sensitive transfer image-receiving sheet of the present invention has, on a support, at least one dye-receiving layer (receptor layer) and at least one heat insulation layer (porous layer). The receptor layer is preferably arranged as a layer most apart from the support. Besides having these layers, the present image-receiving sheet has at least one intermediate layer between the support and the heat insulation layer. In addition, it is preferable that the present image-receiving sheet also has an intermediate layer between the receptor layer and the heat insulation layer. In the present invention, various layers provided between the support and the receptor layer (excepting the heat insulation layer) are referred simply to as "intermediate layers", with examples thereof including undercoat layers, such as a white background adjustment layer, an electrification control layer, an adhesive layer, and a primer layer. It is preferable that the receptor layer, the intermediate layer, and the heat insulation layer be formed by a simultaneous multilayer coating.

Moreover, it is preferable that a curling control layer, a writing layer, and a charge control layer (an electrification control layer) be formed on the backside of the support. Each layer on the backside of the support is applied using a usual method such as roll coating, bar coating, gravure coating, and gravure reverse coating.

(Receptor Layer)

The receptor layer performs functions of receiving dyes transferred from an ink sheet and retaining images formed. In the image-receiving sheet of the present invention, the receptor layer contains a latex polymer.

<Latex Polymer>

The latex polymer that can be used in the present invention will be explained. The heat-sensitive transfer image-receiving sheet of the present invention contains a latex polymer in the receptor layer. The latex polymer that can be used in the receptor layer is a dispersion comprising a hydrophobic, water-insoluble polymer, dispersed in a water-soluble dispersion medium, as fine particles. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004); and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition point (glass transition temperature, Tg) of the latex polymer for use in the present invention is preferably −30° C. to 100° C., more preferably 0° C. to 80° C., further more preferably 10° C. to 70° C., and especially preferably 15° C. to 60° C.

In the present invention, as preferable embodiments of the latex polymer, hydrophobic polymers such as acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or crosslinked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to a layer containing a latex, and polymers having excessively large molecular weight bring about poor filming ability, and therefore both cases are undesirable. Crosslinkable latex polymers are also preferably used.

No particular limitation is imposed on the monomer to be used in synthesizing the latex polymer that can be used in the present invention, and the following monomer groups (a) to (j) may be preferably used as those polymerizable in a usual radical polymerization or ion polymerization method. These monomers may be selected singly or combined freely to synthesize a latex polymer.

—Monomer Groups (a) to (j)—

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates such as methyl acrylate, ethyl acrylate, butyl acrylate, cyclohexyl acrylate, 2-ethylhexyl acrylate, and dodecyl acrylate; substituted alkyl acrylates such as 2-chloroethyl acrylate, benzyl acrylate, and 2-cyanoethyl acrylate; alkyl methacrylates such as methyl methacrylate, butyl methacrylate, 2-ethylhexyl methacrylate, and dodecyl methacrylate; substituted alkyl methacrylates such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids such as monobutyl maleate, dimethyl maleate, monomethyl itaconate, and dibutyl itaconate; multifunctional esters such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) α,β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl)acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

Latex polymers that can be used in the present invention are also commercially available, and polymers described below may be utilized.

Examples of the acrylic-series polymers include Cevian A-4635, 4718, and 4601 (trade names, manufactured by Daicel Chemical Industries); Nipol Lx811, 814, 821, 820, 855 (P-17: Tg 36° C.), and 857×2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE 116 (P-22: Tg 50° C.), AE 119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K.K.); VINYBLAN 2580, 2583, 2641, 2770, 2770H, 2635, 2886, 5202C, and 2706 (trade names, manufactured by Nisshin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-1 24S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, and NS-282LX (trade names, manufactured by Takamatsu Yushi K.K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101 H, Vondic 1320NS, and 1610NS (trade names, manufactured by Dainippon Ink and Chemicals, Incorporated); D-1000, D-2000, D-6000, D-4000, and D-9000 (trade names, manufactured by Dainichi seika Color & Chemicals Mfg. Co., Ltd.); NS-155X, NS-310A, NS-310X, and NS-311X (trade names, manufactured by Takamatsu Yushi K.K.); Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); Nipol Lx416, LX410, LX430, LX435, LXI 10, LX415A, LX438C, 2507H, LX303A, LX407BP series, V1004, and MH5055 (trade names, manufactured by Nippon Zeon Co., Ltd.).

Examples of the polyvinyl chlorides include G351, and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938, and 950 (trade names, manufactured by Nisshin Chemical Industry Co., Ltd.).

Examples of the polyvinylidene chlorides include L502 and L513 (trade names, manufactured by Asahi Kasei Corporation); D-5071 (trade name, manufactured by Dai-Nippon Ink & Chemicals, Inc.).

Examples of the polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.).

Examples of the copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended.

In the present invention, it is preferable to prepare the receptor layer by applying an aqueous type coating solution and then drying it. The "aqueous type" so-called here means that 60% by mass or more of the solvent (dispersion medium) of the coating solution is water. As components other than water in the coating solution, water miscible organic solvents may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The latex polymer for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of the latex polymer. It is described, for example, in Souichi Muroi, "Gosei Latex no Kagaku (Chemistry of Synthetic Latex)", issued by Kobunshi Kanko Kai (1970). Preferable examples of the filming aid are listed below, but the compounds for use in the present invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

Preferable examples of the latex polymer that can be used in the present invention may include polylactates, polyurethanes, polycarbonates, polyesters, polyacetals, SBRs, and polyvinyl chlorides. It is most preferable that, among these compounds, polyesters, polycarbonates, and polyvinyl chlorides be included.

In combination with the latex polymer for use in the present invention, any polymer can be used. The polymer that can be used in combination is preferably transparent or translucent, and generally colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. In the coating liquid, the binder may be dissolved or dispersed in an aqueous solvent or in an organic solvent, or may be in the form of an emulsion.

The glass transition temperature (Tg) of the binder for use in the invention is preferably in the range of −30° C. to 70° C., more preferably −10° C-to 50° C., still more preferably 0° C. to 40° C., in view of film-forming properties (brittleness for working) and image storability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) can be calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is the glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-lnterscience (1989).

The polymer used for the binder for use in the invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare a water dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium; an emulsifier and a polymerization initiator. Various conditions such as the dispersion medium, the monomer concentration, the amount of initiator, the amount of emulsifier, the amount of dispersant, the reaction temperature, and the method for adding monomer are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer for use in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator may be selected from inorganic peroxides such as persulfates and hydrogen peroxide, peroxides described in the "organic peroxide catalogue" of NOF Corporation, and azo compounds as described in the "azo polymerization initiator catalogue" of Wako Pure Chemical Industries, Ltd. Among them, water-soluble peroxides such as persulfates and water-soluble azo compounds as described in the "azo polymerization initiator catalogue" of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl) propionamide), and azobiscyanovaleric acid are more preferable; and peroxides such as ammonium persulfate, sodium persulfate, and potassium persulfate are especially preferable from the viewpoints of image storability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier may be selected from anionic surfactants, nonionic surfactants, cationic surfactants, and ampholytic surfactants. Among them, anionic surfactants are preferable from the viewpoints of dispersibility and image storability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H (trade name) manufactured by Kao Corporation) are still more preferable, and low electrolyte types such as PIONIN A-43-S (trade name, manufactured by Takemoto Oil & Fat Co., Ltd.) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer to be used in the present invention. The chelating agent is a compound capable of coordinating (chelating) a polyvalent ion such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetate, ethylenediaminetetraacetate), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (—Complexane no Kagaku—) (EDTA—Chemistry of Complexane—)", Nankodo (1977). In these compounds, a part of the carboxyl groups may be substituted by an alkali metal salt such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)imino diacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, I-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraactic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-cc-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N"',N"'-hexaacetic acid, and 1,2,3-triaminopropane-N,N,N',N",N"',N"'-hexaacetic acid. In these compounds, a part of the carboxyl groups may be substituted by an alkali metal salt such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties are lowered.

In the synthesis of the latex polymer to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the latex polymer to be used in the present invention, the polymer concentration is preferably 10 mass % to 70 mass %, more preferably 20 mass % to 60 mass %, and especially preferably 30 mass % to 55 mass %, based on the amount of the latex liquid.

The latex polymer is added so that the amount (solid content) of the latex polymer would be preferably 50 to 95% by mass and more preferably 70 to 90% by mass, based on all polymers in the receptor layer.

The latex polymer in the image-receiving sheet of the present invention includes a state of a gel or dried film formed by removing a part of solvents by vaporization.

<Ultraviolet absorber>

Also, in the present invention, in order to improve light resistance, an ultraviolet absorber may be added to the receptor layer. In this case, if this ultraviolet absorber is made to have a higher molecular weight, it can be secured to a receptor layer and can be prevented, for instance, from being diffused into an ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described, for example in JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added in the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a weight average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. When the polymer is made to be used in a form of a latex, a water dispersion-system coating solution may be used in application and coating to form the receptor layer, and this enables reduction of production cost. As a method of making the latex polymer (or making the polymer latex-wise), a method described, for example, in Japanese Patent No. 3,450,339 may be used. As the ultraviolet absorber to be used in a form of a latex, the following commercially available ultraviolet absorbers may be used which include ULS-700, ULS-1700, ULS-1383MA, ULS-1635MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The amount of the ultraviolet-absorber-grafted polymer or its latex is preferably 5 to 50 parts by mass, and more preferably 10 to 30 parts by mass, to 100 parts by mass of the receptor polymer capable of being dyed, to be used to form the receptor layer.

<Releasing Agent>

A releasing agent may be compounded in the receptor layer, in order to prevent thermal fusion with a thermal transfer sheet (ink sheet) when an image is formed. As the releasing agent, any one of silicone oils, phosphate-based releasing agents, fluorine-series compounds, and various wax dispersions may be used, and any of silicone oils, waxes, and fluorine-series compounds is particularly preferably used.

The addition amount of the releasing agent is determined with consideration given to the relationship between the releasability at the time when the image-receiving sheet is peeled off from an ink sheet as described below after transfer, and the friction between the image-receiving sheet and the ink sheet which affects the transportability; and further to influences of the releasing agent upon other properties. In general, the releasing agent is used in an amount of 0.2 to 50 mass %, preferably 0.5 to 30 mass %, based on the coating amount of receptor polymer.

These releasing agents are used in a state of a solution or a dispersion, according to the kind of solvent used in coating the receptor layer.

Those releasing agents may be used singly or as combinations thereof. In general, however, combined use of releasing agents functions advantageously in many cases from the viewpoint of controlling the releasability and other properties.

As the silicone oil, a modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil is preferably used. Among these compounds, a reaction product between a vinyl-modified silicone oil and a hydrogen-modified silicone oil is preferable.

In one of the preferred embodiments of the present invention, when the receptor layer is formed by coating an aqueous composition, it is preferred that a silicone oil be emulsified by a usual method and used in a state of emulsified dispersion.

As to the wax, substances conventionally known as wax can be used. In the present invention, the term "wax" means "an organic substance which has an alkyl chain and is in a solid or semisolid state at room temperature" (in accordance with the definition given in "Kaitei Wax no Seishitsu to Oyo (Revised edition, Properties and Applications of Wax), Saiwai Shobo (1989)). Examples of a substance preferable as the wax include candelilla wax, carnauba wax, rice wax, Japan wax (haze wax), montan wax, ozokerite, paraffin wax, microcrystalline wax, petrolatum, Fischer-Tropsch wax, polyethylene wax, montan wax derivatives, paraffin wax derivatives, microcrystalline wax derivatives, hydrogenated ricinus oil, hydrogenated ricinus oil derivatives, 12-hydroxystearic acid, stearic acid amide, phthalic anhydride imide, chlorinated hydrocarbons, and other mixed waxes. Among these, preferred are carnauba wax, montan wax, montan wax derivatives, paraffin wax, paraffin wax derivatives, microcrystalline wax, microcrystalline wax derivatives, polyethylene wax, and stearic acid amide; more preferred are carnauba wax, montan wax, montan wax derivatives, microcrystalline wax, and stearic acid amide; and further more preferred are paraffin wax, paraffin wax derivatives, montan wax, montan wax derivatives, microcrystalline wax.

The wax is generally chosen from those having melting points of 25° C. to 120° C., preferably 40° C. to 100° C., and more preferably 60° C. to 90° C.

When the receptor layer is formed by coating an aqueous composition, which is a preferred embodiment of the invention, it is preferable that the wax used be in a state of being dispersed in water, and more preferably dispersed in water in the form of fine particles. The method for dispersing wax in water and the method for forming wax into fine particles are described in "Kaitei Wax no Seishitsu to Oyo (Revised edition, Properties and Applications of Wax)", Saiwai Shobo (1989).

The addition amount of wax, as is the case with the addition amount of releasing agent mentioned above, is required to be controlled so as to balance with other properties. Specifically, the range thereof is preferably from 0.5 to 30 mass %, more preferably from 1 to 20 mass %, and further more preferably from 1.5 to 15 mass %, of the amount of total solids in the receptor layer.

As the fluorine-containing releasing agent, fluorine compounds known to show a release property can be used. Surfactants having fluorinated alkyl terminals are widely known as releasing agents. The surfactants having fluorinated alkyl terminals are also known to be usable as coating aids.

The total coating amount of the receptor layer in a dried state is preferably 1 g/m$^2$ to 20 g/m$^2$, more preferably 1.5 g/m$^2$ to 10 g/m$^2$, and further more preferably 1.5 g/m$^2$ to 6 g/m$^2$. Further, the sum of the total coating amount of the receptor layer in a dried state and the coating amount of the intermediate layer, which will be explained later, in a dried state, is preferably 120% or more, and more preferably 200% or more, of the total coating amount of the heat insulation layer in a dried state. The upper limit is preferably 2,000% or less, and more preferably 1,000% or less.

(Heat Insulation Layer)

A heat insulation layer (porous layer) serves to protect the support from heat when a thermal head is used to carry out a transfer operation under heating. Also, because the heat insulation layer has high cushion characteristics, a thermal transfer image-receiving sheet having high printing sensitivity can be obtained even in the case of using paper as a substrate.

In the image-receiving sheet of the present invention, the heat insulation layer contains a hollow polymer.

The hollow polymer in the present invention is polymer particles having independent pores inside of the particles. Examples of the hollow polymer include 1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; 2) foaming type microballoons obtained in the following manner: a low-boiling point liquid such as butane and pentane is encapsulated in a resin constituted of any one, a mixture or a polymer of polyvinylidene chloride, polyacrylonitrile, polyacrylic acid, and polyacrylate, and after the resin coating material is applied, it is heated to expand the low-boiling point liquid inside of the particles whereby the inside of each particle is made to be hollow; and 3) microballoons obtained by foaming the above 2) under heating in advance, to make a hollow polymer.

These hollow polymers preferably have a hollow ratio of about 20 to 70%, and may be used in combinations of two or more, if necessary. Specific examples of the above 1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above 2) include F-30 and F-50 manufactured by Matsumoto Yushi-Seiyaku Co., Ltd. (all of these product names are trade names). Specific examples of the above 3) include F-30E manufactured by Matsumoto Yushi-Seiyaku Co., Ltd, and Expancel 461DE, 551DE and 551DE20 manufactured by Nippon Ferrite (all of these product names are trade names).

The polymer forming the capsule wall of the hollow polymer has no particular restriction as to its glass transition temperature, and the glass transition temperature thereof can be adjusted according to the performance required.

For example, in order to secure thermal insulation over a wide temperature range, the glass transition temperature of the polymer is preferably 70° C. or higher, more preferably 90° C. or higher, and further preferably 100° C. or higher. Moreover, it is also possible to form cross-links inside the polymer structure, for the purpose of imparting heat-resisting properties to the hollow polymer.

In addition, in order to impart cushion properties to the heat insulation layer itself, it is effective to set the glass transition temperature of the hollow polymer to a lower value, and the glass transition temperature chosen for attaining such an effect is preferably 120° C. or below, more preferably 105° C. or below, further more preferably 80° C. or below.

A water-dispersible resin or water-soluble resin is preferably contained, as a binder, in the heat insulation layer containing the hollow polymer. As the binder resin for use in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride, cellulose derivative, casein, starch, and gelatin may be used. Also, these resins may be used either singly or as mixtures.

The solid content of the hollow polymer in the heat insulation layer preferably falls in a range from 5 to 2,000 parts by mass, more preferably 40 to 1500 parts by weight, further more preferably 50 mass parts by weight or more (preferably 50 to 1,500 parts by mass), and particularly preferably 60 parts by mass or more (preferably 60 to 1,500 parts by mass), when the solid content of the binder resin is taken as 100 parts by mass. Also, the ratio by mass of the solid content of the hollow polymer in the coating solution is preferably 1 to 70% by mass and more preferably 10 to 40% by mass. If the ratio of the hollow polymer is excessively low, sufficient heat insulation cannot be obtained, whereas if the ratio of the hollow polymer is excessively large, the adhesion between the hollow polymers is reduced, posing problems, for example, powder fall or film separation.

The particle size of the hollow polymer is preferably 0.1 to 20 μm, more preferably 0.1 to 2 μm and particularly preferably 0.1 to 1 μm. Also, the glass transition temperature (Tg) of the hollow polymer is preferably 70° C. or more and more preferably 100° C. or more.

The heat insulation layer preferably contains a gelatin. The amount of the gelatin in the coating solution for the heat insulation layer is preferably 0.5 to 14% by mass, and particularly preferably 1 to 6% by mass. Also, the coating amount of the above hollow polymer in the heat insulation layer is preferably 1 to 100 g/m$^2$, and more preferably 5 to 20 g/m$^2$.

The thickness of the heat insulation layer containing the hollow polymer is preferably 5 to 50 μm, more preferably 5 to 40 μm, and furthermore preferably 5 to 20 μm.

(Intermediate Layer)

The heat-sensitive transfer image-receiving sheet of the present invention has at least one intermediate layer (undercoat layer) between the support and the heat insulation layer. Examples of the undercoat layer include a white background adjustment layer, an electrification control layer (charge control layer), an adhesive layer, and a primer layer. These layers may have a structure as described in, for example, each publication of Japanese Patent Nos. 3,585,599 and 2,925,244.

In addition, the heat-sensitive transfer image-receiving sheet of the present invention preferably has an intermediate layer between the receptor layer and the heat insulation layer. By providing such an intermediate layer, the flatness of the receptor layer can be secured without being affected by surface condition of the heat insulation layer. When two or more intermediate layers are provided, their compositions may be the same or different from each other.

The intermediate layer contains one or both of a latex polymer having a lower glass transition point than a latex polymer contained in the receptor layer and a water-soluble polymer.

<Latex Polymer>

In the intermediate layer, of the latex polymers described above, those having lower glass transition points than the latex polymer contained in the receptor layer are usable. The difference between the glass transition temperature of a latex polymer contained in the receptor layer and that of a latex polymer contained in the intermediate layer is preferably from 10° C. to 150° C., more preferably from 20° C. to 100° C. Further, preferred are the cases where the glass transition temperature of the latex polymer is 60° C. or below. The lower limit has no particular restriction so far as the foregoing relation is satisfied, but it is preferably −100° C. or above.

Examples of the latex polymer usable in the intermediate layer (undercoat layer) include the latex polymers recited in the description of the receptor layer.

The addition amount of latex polymer in the intermediate layer provided between the support and the heat insulation layer is preferably from 0.03 to 30 g/m$^2$, more preferably from 0.1 to 10 g/m$^2$.

The addition amount of latex polymer in the intermediate layer provided between the receptor layer and the heat insulation layer is preferably from 0.03 to 30 g/m$^2$, more preferably from 0.1 to 10 g/m$^2$.

<Water-soluble Polymer>

The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention. The water-soluble polymer which can be used in the present invention preferably dissolves 0.05 g or more, more preferably 0.1 g or more, further preferably 0.5 g or more, particularly preferably 1 g or more, in 100 g of water at 20° C.

Among the water-soluble polymers which can be used in the present invention, the natural polymers and the semi-synthetic polymers will be explained in detail. Specific examples include the following polymers: plant polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial polysaccharides such as xanthan gums (e.g. Keltrol T, manufactured by Kelco) and dextrins (e.g. Nadex 360, manufactured by National Starch & Chemical Co.); animal natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyidiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-22 1, Z-446, Z-56 1, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3$M (M represents a hydrogen atom or an alkali metal) or copolymers of these vinyl monomers among them or with other vinyl monomers (for example, sodium methacrylate, ammonium methacrylate, Sumikagel L-5H (trade name) manufactured by Sumitomo Chemical Co., Ltd). may also be used.

Among the water-soluble synthetic polymers usable in the present invention, polyvinyl alcohols will be explained in more detail. Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS];

PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0mass %; degree of saponification 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; PVA-HC [PVA content: 90.0 mass %; degree of saponification: 99.85 mol % or more; content of sodium acetate: 2.5 mass %; volatile constituent: 8.5 mass %; viscosity (4 mass %; 20 ° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-2 10 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated surface quality can be improved by an addition of boric acid. The amount of boric acid added is preferably 0.01 to 40 mass % with respect to polyvinyl alcohol.

Preferred binders are transparent or semitransparent, generally colorless, and water-soluble. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides.

The water-soluble polymer for use in the invention is preferably a gelatin or a polyvinyl alcohol.

The addition amount of the water-soluble polymer in the intermediate layer provided between the support and the heat insulation layer is preferably from 0.03 to 30 g/m$^2$, more preferably from 0.1 to 10 g/m$^2$.

The addition amount of the water-soluble polymer in the intermediate layer provided between the receptor layer and the heat insulation layer is preferably from 0.03 to 30 g/m$^2$, more preferably from 0.1 to 10 g/m$^2$.

In addition, the coating amount of the intermediate layer in a dried state, or the sum of the coating amounts of the intermediate layer in a dried state and the receptor layer in a dried state is preferably at least 120%, far preferably at least 150%, further preferably at least 170%, of the total coating amount of the heat insulation layer in a dried state. Additionally, the sum is furthermore preferably 200% or above, and may be even 300% or above. Herein, the upper limit is preferably 1,000% or below, far preferably 500% or below.

Under these conditions, it is particularly preferred that the intermediate layer contain a latex polymer having a glass transition temperature of 60° C. or below. Incidentally, the expression "a dried state" means a state after volatile ingredients are dried up by vaporization drying, and means so-called after-drying state.

(Support)

In the present invention, a waterproof support is preferably used as the support. The use of the waterproof support makes it possible to prevent the support from absorbing moisture, whereby a variation in the performance of the receptor layer with a lapse of time can be prevented. As the waterproof support, for example, coated paper or laminate paper may be used. It is particularly advantageous for the present invention to use a paper both sides of which are laminated by a polyethylene, as the support.

—Coated Paper—

The aforementioned coated paper is paper obtained by coating a sheet such as base paper with various resins, rubber latexes, or polymeric materials, on one side or both sides of the sheet, wherein the coating amount differs depending on its use. Examples of such coated paper include art paper, cast coated paper, and Yankee paper.

It is proper to use a thermoplastic resin as the resin to be applied to the surface of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described, for example, in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either singly or in combination of two or more.

The thermoplastic resin may contain a whitener, a conductive agent, a filler, a pigment or dye including, for example, titanium oxide, ultramarine blue, and carbon black; or the like, if necessary.

—Laminated Paper—

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used singly, or in combination of two or more.

The method for lamination has no particular restriction, but a laminated paper may be formed by pasting a film formed and a sheet (e.g., a base paper), via an adhesive, or by extruding a resin directly onto a sheet (e.g. base paper). Form the point of manufacturing cost, the method of extruding a resin directly onto a sheet (e.g., base paper), to form a laminating film is preferable.

The polyolefin is preferably a polyethylene, and is more preferably one formed using a low-density polyethylene. For improving the heat resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylene is not particularly limited. Preferably, both of the high-density polyethylene and the low-density polyethylene have a melt index of 1.0 to 40 g/10 minute and a high extrudability.

The coating amount of the resin layer to be laminated has no particular restriction, but it is preferably at least 120%, more preferably at least 150%, of the coating amount of the heat insulation layer in a dried state (Relationship A). The upper limit of the coating amount is preferably 500% or below, and more preferably 300% or below.

In addition, the sum of the coating amount of the resin layer to be laminated and the total coating amount of the layers to be arranged on the side on which images are formed, except for the heat insulation layer, all in a dried state, is preferably at least 150%, far preferably at least 200%, and further preferably at least 300%, of the coating amount of the heat insulation layer in a dried state (Relationship B). (More preferably, the sum of the coating amount of the resin layer to be laminated and the coating amount of the receptor layer in a dried state is preferably at least 150%, far preferably at least 200%, further preferably at least 300%, of the coating amount of the heat insulation layer in a dried state.) The upper limit thereof is preferably 1,000% or below, and more preferably 500% or below.

It is particularly preferred that the coating amount of the resin layer to be laminated on the side where images are to be transferred, has at least one of the foregoing two types of relationships A and B.

Moreover, particularly preferred is a case where the heat insulation layer contains a hollow polymer having a glass transition temperature of 70° C. or higher in a proportion of at least 50 mass %.

Additionally, in the present specification, the mass per unit area of resin layer to be laminated is treated as the "coating amount". In the case of preparing a laminated paper by pasting a layer for lamination prepared in advance onto a sheet (e.g. base paper), the mass per unit area of this laminate layer is also expressed as "coating amount" for the sake of simplicity.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that of a support for use in color silver halide photography.

(Curling Control Layer)

When the substrate is exposed as it is, there is the case where the heat-sensitive transfer image-receiving sheet is made to curl by moisture and temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, each publication of JP-A-61-110135 and JP-A-6-202295.

(Writing Layer and Charge Control Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the publication of Japanese Patent No. 3585585.

Hereinafter, a method of producing the heat-sensitive transfer image-receiving sheet of the present invention will be explained.

The heat-sensitive transfer image-receiving sheet of the present invention can be formed by coating, on a support, at least one receptor layer, at least one intermediate layer, and at least one heat insulation layer, by a simultaneous multilayer coating method.

It is known that in the case of producing an image-receiving sheet of a multilayered structure, which sheet has layers having different functions from each other (for example, air cell layer, heat insulation layer, intermediate layer, and receptor layer) on a support, it may be produced by applying and overlapping each layer one by one, or by pasting layers prepared in advance by coating a support with each layer, as shown in, for example, each publication of JP-A-2004-106283, JP-A-2004-181888, and JP-A-2004-345267. It has been known in photographic industries, on the other hand, that productivity can be greatly improved by applying plural layers simultaneously as a multilayer. There are known methods such as the so-called slide coating (slide coating method) and curtain coating (curtain coating method) as described in, for example, each publication or specification of U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons Company, 1995, pp. 101-103.

In the present invention, it has been found that the productivity is greatly improved and image defects can be remarkably reduced at the same time, by using the above simultaneous multilayer coating for the production of an image-receiving sheet having a multilayer structure.

The plural layers in the present invention are structured using resins as its major components. Coating solutions for forming each layer are preferably water-dispersed latexes. The solid content by mass of the resin put in a latex state in each layer coating solution is preferably in a range from 5 to 80% and particularly preferably 20 to 60%. The average particle size of the resin contained in the above water-dispersed latex is preferably 5 μm or less and particularly preferably 1 μm or less. The above water dispersed latex may contain known additives, such as surfactants, dispersants, and binder resins, according to the need.

In the present invention, it is preferred that a laminate composed of plural layers be formed on a support and rapidly dried, according to the method described in U.S. Pat. No. 2,761,791. For example, in the case of a multilayer structure that solidifies using a resin, it is preferable to raise the temperature immediately after the plural layers are formed on the support. Also, in the case where a binder that is gelled at a lower temperature (e.g., a gelatin) is contained, there is the case where it is preferable to drop the temperature immediately after the plural layers are formed on the support.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

A heat-sensitive transfer sheet (ink sheet) to be used together with the aforementioned heat-sensitive transfer image-receiving sheet according to the present invention, in the formation of a thermal-transferred image, can be produced by disposing a dye layer containing a diffusion transfer dye on a support. As the heat-sensitive transfer sheet, any ink sheet may be used. As a means for providing heat energy in the thermal transfer, any of the conventionally known providing means may be used. For example, a heat energy of about 5 to 100 mJ/mm$^2$ is applied by controlling recording time in a recording device such as a thermal printer (trade name: Video Printer VY-100, manufactured by Hitachi, Ltd.), whereby the expected object can be attained sufficiently.

Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmission type manuscript-making sheets, by optionally selecting the type of support.

The present invention may be utilized for printers, copying machines and the like, which employs a heat-sensitive transfer recording system.

The present invention will be described in more detail based on the following examples, but the invention is not intended to be limited thereto.

EXAMPLES

Reference Example (Preparation of Ink Sheet)

A polyester film 6.0 μm in thickness (trade name: Lumirror, manufactured by Toray Industries, Inc.) was used as the substrate film. A heat-resistant slip layer (thickness: 1 μm) was formed on the backside of the film, and the following yellow, magenta, and cyan compositions were respectively applied as a monochromatic layer (coating amount: 1 g/m$^2$ after drying) on the front side.

| Yellow composition | |
|---|---|
| Dye (trade name: Macrolex Yellow 6G, manufactured by Byer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

| Magenta composition | |
|---|---|
| Magenta dye (Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

| Cyan composition | |
|---|---|
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

(Preparation of Support)

A pulp slurry was prepared from 50 parts by mass of hardwood kraft pulp (LBKP) of acacia origin and 50 parts by mass of hardwood kraft pulp (LBKP) of aspen origin, by beating these pulps by means of a disk refiner until Canadian standard freeness reached to 300 ml.

To the pulp slurry thus prepared were added, on a pulp basis, 1.3% of modified cationic starch (CAT0304L, trade name, manufactured by Nippon NSC), 0.15% of anionic polyacrylamide (DA4104, trade name, manufactured by Seiko PMC Corporation), 0.29% of an alkylketene dicer (SIZEPINE K, trade name, manufactured by Arakawa Chemical Industries, Ltd.), 0.29% of epoxidated behenic acid amide, and 0.32% of polyamide polyamine epichlorohydrin (ARAFIX 100, trade name, manufactured by Arakawa Chemical Industries, Ltd.), and thereafter 0.12% of a defoaming agent was further added.

The resulting pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, either side of the raw paper thus made was coated with 1 g/m$^2$ of polyvinyl alcohol (KL-118, trade name, manufactured by Kuraray Co., Ltd.) with a size press, then, dried and further subjected to calendering treatment. Therein, the papermaking was performed so that the raw paper had a grammage (basis weight) of 166 g/m$^2$, and the raw paper (base paper) having a thickness of 160 μm was obtained.

The wire side (backside) of the base paper obtained was subjected to corona discharge treatment, and thereto a resin composition, in which a high-density polyethylene having an MFR (which stands for a melt flow rate, and hereinafter has the same meaning) of 16.0 g/10 min and a density of 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene having an MFR of 4to g/10 min and a density of 0.93 g/cm$^3$ were mixed at a ratio of 75 to 25 by mass, was applied so as to have a thickness of 25 g/m$^2$, by means of a melt extruder, thereby forming a thermoplastic resin layer with a mat surface (the side to which this thermoplastic resin layer was provided is hereinafter referred to as "backside"). The thermoplastic resin layer at the backside was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating had a dry mass of 0.2 g/m$^2$. Subsequently, the front surface of the base paper was subjected to corona discharge treatment, and then coated with 24 g/m$^2$ of a low-density polyethylene having an MFR of 4.0 g/10 min and a density of 0.93 g/m$^2$ and containing 10 mass % of titanium oxide, by means of a melt extruder, thereby forming a thermoplastic resin layer with a specular surface. The low-density polyethylene used on the front surface had a glass transition temperature of −120° C.

Example 1

Preparation of Image-Receiving Sheets

(1-1) Preparation of Sample 101 (Comparative Example)

The surface of the support prepared in the foregoing manner was subjected to corona discharge treatment, and then provided with a gelatin undercoat layer containing sodium dodecylbenzenesulfonate. On the undercoat layer, a heat insulation layer A, and a receptor layer A, having the following compositions, respectively, were coated in a multilayered state, in which these layers were laminated in order of mention from the support, by the multilayer coating technique as illustrated in FIG. 9of U.S. Pat. No. 2,761,791. Immediately after the coating, the laminated layers were dried for 20 minutes at 30° C. Therein, the coating was performed so that the coating amount of each layer after being dried would be as follows: the heat insulation layer A, 15 g/m$^2$; and the receptor layer A, 4.0 g/m$^2$.

| Receptor layer A | |
|---|---|
| Vinyl chloride-series latex (Vinyblan 900, trade name, manufactured by Nisshin Chemicals Co., Ltd.) | 78 parts by mass |
| Water | 15 parts by mass |
| Wax montanate (J537, trade name, manufactured by Chukyo Yushi Co., Ltd.) | 10 parts by mass |

| Heat insulation layer A | |
|---|---|
| Hollow latex polymer (MH5055, trade name, manufactured by Nippon Zeon Co., Ltd.) | 334 parts by mass |
| Gelatin | 26 parts by mass |
| Water | 50 parts by mass |

Here, the vinyl chloride-series latex used in the receptor layer A had a glass transition temperature of 73° C., and the hollow latex polymer used in the heat insulation layer A was a water-dispersion of a hollow-structured polymer having a glass transition temperature of 105° C. and an outside diameter of 0.5 μm.

(1-2) Preparation of Sample 102 (This invention)

By the same method as adopted in making Sample 101, an intermediate layer A, a heat insulation layer A, and a receptor layer A, having the following compositions, respectively, were coated in a multilayered state, in which these layers were laminated in order of mention from the support. Immediately after the coating, these layers were dried for 20 minutes at 30° C. Therein, the coating was performed so that the coating amount of each layer after being dried would be as follows: the intermediate layer A, 5 g/m$^2$; the heat insulation layer A, 15 g/m$^2$; and the receptor layer A, 4.0 g/m$^2$.

| Receptor layer A | |
|---|---|
| Vinyl chloride-series latex (Vinyblan 900, trade name, manufactured by Nisshin Chemicals Co., Ltd.) | 78 parts by mass |
| Water | 15 parts by mass |
| Wax montanate (J537, trade name, manufactured by Chukyo Yushi Co., Ltd.) | 10 parts by mass |

| Heat insulation layer A | |
|---|---|
| Hollow latex polymer (MH5055, trade name, manufactured by Nippon Zeon Co., Ltd.) | 334 parts by mass |
| Gelatin | 26 parts by mass |
| Water | 50 parts by mass |

| Intermediate Layer A | |
|---|---|
| SBR latex polymer (SN307, trade name, manufactured by Nippon A&L Inc.) | 127 parts by mass |
| Polyvinyl alcohol (PVA102, trade name, manufactured by Kuraray Poval Company) | 7 parts by mass |
| Water | 63 parts by mass |

Herein, the glass transition temperature of the SBR latex polymer used was 5° C.

(1-3) Preparation of Sample 103 (This Invention)

By the same method as adopted in making Sample 101, an intermediate layer B, a heat insulation layer A, and a receptor layer A, having the following compositions, respectively, were coated in a multilayered state, in which these layers were laminated in order of mention from the support. Immediately after the coating, these layers were dried for 20 minutes at 30° C. Therein, the coating was performed so that the coating amount of each layer after being dried would be as follows: the intermediate layer B, 0.4 g/m$^2$; the heat insulation layer A, 15 g/m$^2$; and the receptor layer A, 4.0 g/m$^2$.

| Receptor layer A | |
|---|---|
| Vinyl chloride-series latex (Vinyblan 900, trade name, manufactured by Nisshin Chemicals Co., Ltd.) | 78 parts by mass |
| Water | 15 parts by mass |
| Wax montanate (J537, trade name, manufactured by Chukyo Yushi Co., Ltd.) | 10 parts by mass |

| Heat insulation layer A | |
|---|---|
| Hollow latex polymer (MH5055, trade name, manufactured by Nippon Zeon Co., Ltd.) | 334 parts by mass |
| Gelatin | 26 parts by mass |
| Water | 50 parts by mass |

| Intermediate layer B | |
|---|---|
| Gelatin | 25 parts by mass |
| Water | 99 parts by mass |

(1-4) Preparation of Sample 104 (This Invention)

By the same method as adopted in making Sample 101, an intermediate layer B, an intermediate layer A, a heat insulation layer A, and a receptor layer A, having the following compositions, respectively, were coated in a multilayered state, in which these layers were laminated in order of mention from the support. Immediately after the coating, these layers were dried for 20 minutes at 30° C. Therein, the coating was performed so that the coating amount of each layer after being dried would be as follows: the intermediate layer B, 0.4 g/m$^2$; the intermediate layer A, 5 g/m$^2$; the heat insulation layer A, 15 g/m$^2$; and the receptor layer A, 4.0 g/m$^2$.

| Receptor layer A | |
|---|---|
| Vinyl chloride-series latex (Vinyblan 900, trade name, manufactured by Nisshin Chemicals Co., Ltd.) | 78 parts by mass |
| Water | 15 parts by mass |
| Wax montanate (J537, trade name, manufactured by Chukyo Yushi Co., Ltd.) | 10 parts by mass |

| Heat insulation layer A | |
|---|---|
| Hollow latex polymer (MH5055, trade name, manufactured by Nippon Zeon Co., Ltd.) | 334 parts by mass |
| Gelatin | 26 parts by mass |
| Water | 50 parts by mass |

| Intermediate Layer A | |
|---|---|
| SBR latex polymer (SN307, trade name, manufactured by Nippon A&L Inc.) | 127 parts by mass |
| Polyvinyl alcohol (PVA102, trade name, manufactured by Kuraray Poval Company) | 7 parts by mass |
| Water | 63 parts by mass |

| Intermediate Layer B | |
|---|---|
| Gelatin | 25 parts by mass |
| Water | 99 parts by mass |

(1-5) Preparation of Sample 105 (This Invention)

By the same method as adopted in making Sample 101, an intermediate layer A, a heat insulation layer A, an intermediate layer B, and a receptor layer A, having the following compositions, respectively, were coated in a multilayered state, in which these layers were laminated in order of mention from the support. Immediately after the coating, these layers were dried for 20 minutes at 30° C. Therein, the coating was performed so that the coating amount of each layer after being dried would be as follows: the intermediate layer A, 5 g/m$^2$; the heat insulation layer A, 15 g/m$^2$; the intermediate layer B, 0.4 g/m$^2$; and the receptor layer A, 4.0 g/m$^2$.

| Receptor layer A | |
|---|---|
| Vinyl chloride-series latex (Vinyblan 900, trade name, manufactured by Nisshin Chemicals Co., Ltd.) | 78 parts by mass |
| Water | 15 parts by mass |
| Wax montanate (J537, trade name, manufactured by Chukyo Yushi Co., Ltd.) | 10 parts by mass |

| Intermediate Layer B | |
|---|---|
| Gelatin | 25 parts by mass |
| Water | 99 parts by mass |

| Heat insulation layer A | |
|---|---|
| Hollow latex polymer (MH5055, trade name, manufactured by Nippon Zeon Co., Ltd.) | 334 parts by mass |
| Gelatin | 26 parts by mass |
| Water | 50 parts by mass |

| Intermediate layer A | |
|---|---|
| SBR latex polymer (SN307, trade name, manufactured by Nippon A&L Inc.) | 127 parts by mass |
| Polyvinyl alcohol (PVA102, trade name, manufactured by Kuraray Poval Company) | 7 parts by mass |
| Water | 63 parts by mass |

(Image Formation)

The ink sheets of the reference example and the image-receiving sheets of Samples 101 to 105 were each worked to be made loadable in a dye sublimation printer, DPB1500 (trade name, manufactured by Nidec Copal Corporation), and image outputs were produced on those image-receiving sheets in settings that permit formation of gray solid images having a density of 1.0, in a high-speed printing mode.

(Image Evaluation)

The gray solid images obtained under the foregoing conditions were evaluated by visual inspection. A few white, spot-shaped defects measuring about 150 μm in diameter were noticed in Sample 101 (Comparative example), but no defects were observed in Samples 102 to 105 (This invention).

(Storage of Images)

The same gray solid images of the image-receiving sheet Samples 101 to 105 that underwent the aforesaid evaluation were stored for 4 weeks under the conditions of 70° C. and 70% R.H., and thereafter the these gray solid images were evaluated. As a result, it was observed that Sample 101 (Comparative example) suffered a density drop from 1.0 to 0.65, but no drop in density were perceived in Samples 102 to 105 (This invention).

As can be seen from these results, Samples 102 to 105 according to the present invention generated no white, spot-shaped defects in their gray images, and suffered no changes in densities of images on image-receiving sheets after storage.

Example 2

Preparation of Samples 201 to 206 (This Invention)

Samples 201 to 206 were prepared in the same manner as Sample 102, except that the resin layer on the front side (the side where images are to be transferred) of the support, the intermediate layer A, the heat insulation layer A, and the receptor layer A were coated so as to have the coating amounts (in a dried state) shown in Table 1, respectively.

TABLE 1

Structures of Samples 201 to 206

| Sample No | Coating amount of front-side resin layer | Coating amount of Intermediate layer A | Coating amount of Heat insulation layer A | Coating amount of Receptor layer A | Remarks |
|---|---|---|---|---|---|
| 201 | 24 g/m$^2$ | 0 g/m$^2$ | 10 g/m$^2$ | 4 g/m$^2$ | Comparative example |
| 202 | 24 g/m$^2$ | 0 g/m$^2$ | 30 g/m$^2$ | 4 g/m$^2$ | Comparative example |
| 203 | 24 g/m$^2$ | 10 g/m$^2$ | 30 g/m$^2$ | 4 g/m$^2$ | This invention |
| 204 | 28 g/m$^2$ | 5 g/m$^2$ | 30 g/m$^2$ | 4 g/m$^2$ | This invention |
| 205 | 24 g/m$^2$ | 20 g/m$^2$ | 20 g/m$^2$ | 4 g/m$^2$ | This invention |
| 206 | 28 g/m$^2$ | 30 g/m$^2$ | 20 g/m$^2$ | 4 g/m$^2$ | This invention |

(Image Formation)

Samples 201 to 206 were each worked to be made loadable in a sublimation printer, ASK2000 (trade name, manufactured by Fuji Photo Film Co., Ltd.), and were loaded together with the ink ribbon for ASK2000 use; and image outputs were produced on those sample sheets in settings that permit formation of gray solid images having a density of 0.4, in a high-speed printing mode.

Further, outputs of black solid images of maximum densities were produced, and V densities were measured with Xrite310 (trade name, manufactured by X-Rite, Incorporated).

(Image Evaluation)

The gray solid images obtained under the foregoing condition were evaluated by visual inspection. Herein, the evaluation criteria were: samples which attained uniform gray images, 5 points; samples which attained images that had no white, spot-shaped defects but were inferior in uniformity, 4 points; samples which attained images that had a few white, spot-shaped defects, 3 points; samples which attained images that had many white, spot-shaped defects, 2 points; and samples which attained images that had white, spot-shaped defects over the whole surface, 1 point. Results obtained are shown in Table 2.

TABLE 2

State of Image Outputs produced at Density of 0.4 on Samples 201 to 206

| Sample No | Remarks | Solid gray image with density of 0.4 | Dmax |
|---|---|---|---|
| 201 | Comparative example | 2 points | 1.97 |
| 202 | Comparative example | 1 points | 2.00 |
| 203 | This invention | 3 points | 2.02 |
| 204 | This invention | 3 points | 2.03 |
| 205 | This invention | 4 points | 2.04 |
| 206 | This invention | 5 points | 2.05 |

It was found from the results shown in Table 2 that Samples 203 to 206 according to the present invention gave high-quality images, which were reduced in defects, such as white, spot-shaped defects due to poor transfer at low-density-image areas and were excellent in color formation at high-density areas. Further, of Samples 203 to 206 according to the present invention, Samples 205 and 206 were free from white, spot-like defects and exhibited higher sensitivities; especially Sample 206 attained a uniform gray image.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer image-receiving sheet having, on a support, at least one receptor layer containing a latex polymer and at least one heat insulation layer containing hollow particles polymer, and further having, between the support and the heat insulation layer, at least one intermediate layer which contains one or both of 1) a latex polymer having a lower glass transition point than that of the latex polymer in the receptor layer and 2) a water-soluble polymer.

2. The heat-sensitive transfer image-receiving sheet as claimed in claim 1, wherein the intermediate layer contains the latex polymer having a lower glass transition point than that of the latex polymer in the receptor layer.

3. The heat-sensitive transfer image-receiving sheet as claimed in claim 1, wherein the intermediate layer contains the water-soluble polymer.

4. The heat-sensitive transfer image-receiving sheet as claimed in claim 1, wherein a glass transition point of the latex polymer contained in the receptor layer is −30° C. to 100° C.

5. The heat-sensitive transfer image-receiving sheet as claimed in claim 1, wherein the glass transition point of the latex polymer contained in the intermediate layer is lower than that of the latex polymer contained in the receptor layer by 10° C. to 150° C.

6. The heat-sensitive transfer image-receiving sheet as claimed in claim 1, wherein the glass transition point of the latex polymer contained in the intermediate layer is 60° C. or less.

7. The heat-sensitive transfer image-receiving sheet as claimed in claim 1, wherein the glass transition point of the hollow polymer is 70° C. or more.

8. The heat-sensitive transfer image-receiving sheet as claimed in claim 1, wherein the heat insulation layer contains hollow particles polymer having a glass transition point of 70° C. or more in a content of at least 50 parts by mass on a solids basis when a content of binder resin forming the heat insulation layer is taken as 100 parts by mass on a solids basis.

9. The heat-sensitive transfer image-receiving sheet as claimed in claim 1, wherein a total coating amount of the intermediate layer in a dried state is at least 120% of a total coating amount of the heat insulation layer in a dried state.

10. The heat-sensitive transfer image-receiving sheet as claimed in claim 1, wherein the heat insulation layer contains hollow particles polymer having a glass transition point of 70° C. or higher in a content of at least 50 parts by mass on a solids basis when a content of binder resin forming the heat insulation layer is taken as 100 parts by mass on a solids basis, wherein the intermediate layer contains a latex polymer having a glass transition point of 60° C. or lower, and wherein a coating amount of the intermediate layer in a dried state or a sum of coating amounts of the intermediate layer and the receptor layer in a dried state, is at least 120% of a total coating amount of the heat insulation layer in a dried state.

11. The heat-sensitive transfer image-receiving sheet as claimed in claim 10, wherein the coating amount of the intermediate layer in a dried state or the sum of the coating amounts of the intermediate layer and the receptor layer in a dried state is at least 150% of a total coating amount of the heat insulation layer in a dried state.

12. The heat-sensitive transfer image-receiving sheet as claimed in claim 10, wherein the coating amount of the intermediate layer in a dried state or the sum of the coating amounts of the intermediate layer and the receptor layer in a dried state is at least 170% of a total coating amount of the heat insulation layer in a dried state.

13. The heat-sensitive transfer image-receiving sheet as claimed in claim 1, which has, between the receptor layer and the heat insulation layer, an intermediate layer which is selected from an intermediate layer containing a latex polymer having a lower glass transition point than that of the latex polymer in the receptor layer and an intermediate layer containing a water-soluble polymer.

14. The heat-sensitive transfer image-receiving sheet as claimed in claim 1, wherein the support is a paper support both sides of which are laminated by a thermoplastic resin.

15. The heat-sensitive transfer image-receiving sheet as claimed in claim 14, wherein the heat insulation layer contains hollow particles polymer having a glass transition point of 70° C. or higher in a proportion of 50 mass % or above, and wherein a coating amount of the thermoplastic resin laminating the support on the side to which images are to be transferred is at least 120% of a coating amount of the heat insulation layer in a dried state.

16. The heat-sensitive transfer image-receiving sheet as claimed in claim 14, wherein the heat insulation layer contains hollow particles polymer having a glass transition point of 70° C. or higher in a proportion of 50 mass % or above, and wherein the sum of a coating amount of the receptor layer in a dried state, a coating amount of the intermediate layer in a dried state, and a coating amount of the thermoplastic resin laminating the support on the side to which images are to be transferred is at least 150% of a coating amount of the heat insulation layer in a dried state.

17. The heat-sensitive transfer image-receiving sheet as claimed in claim 1, wherein the support is a paper support both sides of which are laminated by a thermoplastic resin, which is a polyethylene.

18. The heat-sensitive transfer image-receiving sheet as claimed in claim 1, wherein the latex polymer in the receptor layer has a repeating unit derived from vinyl chloride.

19. The heat-sensitive transfer image-receiving sheet as claimed in claim 1, wherein the latex polymer in the receptor layer is either 1) or 2);

1) a poly(vinyl chloride);

2) a copolymer of a vinyl chloride monomer and at least one monomer selected from α,β-unsaturated carboxylates and α,β-unsaturated carboxylic acids and salts thereof.

* * * * *